US006409161B1

(12) United States Patent
Wolff et al.

(10) Patent No.: US 6,409,161 B1
(45) Date of Patent: Jun. 25, 2002

(54) DOUBLE STATION HYDRAULICALLY OPERATED MACHINING VISE

(75) Inventors: Bradley D. Wolff, Fairport; Matthew T. Hoyt, Rochester, both of NY (US); David L. Durfee, Jr., Meadville, PA (US)

(73) Assignee: Parlec, Inc., Fairport, NY (US)

( * ) Notice: Subject to any disclaimer, the term of this patent is extended or adjusted under 35 U.S.C. 154(b) by 0 days.

(21) Appl. No.: 09/789,907

(22) Filed: Feb. 22, 2001

(51) Int. Cl.[7] ..... B25B 5/16

(52) U.S. Cl. ..... 269/43; 269/271; 269/134; 269/136

(58) Field of Search ..... 269/43, 136, 154, 269/134, 244, 282, 906, 283, 88, 138, 152, 153, 279, 242, 280, 284, 309, 271

(56) References Cited

U.S. PATENT DOCUMENTS 6,017,026 A * 1/2000 Durfee ..... 269/271
6,170,814 B1 * 1/2001 Swann ..... 269/136
6,244,580 B1 * 6/2001 Durfee ..... 269/43
6,250,620 B1 * 6/2001 Durfee ..... 269/43

* cited by examiner

*Primary Examiner*—Joseph J. Hail, III
*Assistant Examiner*—Daniel Shanley
(74) *Attorney, Agent, or Firm*—Shlesinger, Fitzsimmons & Shlesinger

(57) ABSTRACT

The housing of a two station machining device has thereon a stationary jaw and two movable jaws reciprocable between open and closed positions relative to the stationary jaw by a pair of spaced slides that are reciprocable in a recess in the housing beneath the work surface. A piston in the recess has one end thereof secured to one of the slides and has its other end slidable sealingly in an axial bore and counterbore in the other slide. Normally the slides and the piston are retained resiliently in first limit positions in which the movable jaws are disposed in their open positions. Hydraulic fluid under pressure is supplied to the bore in the other slide beneath the head of the piston initially to move the piston and the one slide into second limit positions in which the jaw connected to the one slide is moved to its closed position, and then to move the other slide to a second limit position and its associated jaw to be moved to its closed position. When the hydraulic fluid is allowed to return to its source, the slides and piston return to their first limit positions.

11 Claims, 4 Drawing Sheets

DOUBLE STATION HYDRAULICALLY OPERATED MACHINING VISE

BACKGROUND OF THE INVENTION

This invention relates to a double station machining vise having a stationary jaw positioned between two movable jaws, and which can be operated selectively to secure workpieces against either or both sides of the stationary jaw. Even more particularly this invention is related to a machining vice having two movable jaws which are hydraulically operable selectively to secure the different workpieces against opposite sides of a stationary jaw, or one workpiece against one side of the stationary jaw.

Heretofore it has been commonplace to employ a machining vise having positioned centrally on the frame thereof a stationary jaw positioned between two jaws which are movably mounted on the frame selectively to secure a workpiece against one side or the other of the stationaryjaw. Typical such machining vises are disclosed in U.S. Pat. No. 6,017,026, U.S. Pat. Nos. 5,505,437, 5,921,534 and U.S. Pat. No. 5,458,321. While these prior art vises are similar in function, the means for actuating the movable jaws generally rely upon mechanical connections to effect movement of the movable jaws relative to the associated stationary jaw. Although the U.S. Pat. No. 6,017,026 discloses means for hydraulically operating a two station machining vise, the problem is that the system employs hydraulic means in combination with a rotary spline mechanism for manipulating the movable jaws. Basically the patent discloses a combined rotary screw drive and hydraulic system for operating a vise utilizing one or two movable jaws and one stationary jaw, and suggests that when two movable jaws are employed the same type of apparatus is employed for manipulating each of the two movable jaws. The result is that a two line hydraulic system must be employed for moving each movable jaw to and from work clamping positions.

It is an object of this invention, therefore, to provide an improved hydraulically operated two jaw machining vise in which each of the two movable jaws of the vise are manipulated by a single, hydraulically operated system.

Still another object of this invention is to provide an improved, hydraulically operated two jaw machining vise which is substantially more inexpensive and easier to operate than prior such machining vises.

More specifically it is an object of this invention to provide an improved two movable jaw machining vise having a single piston operating system for manipulating the slides which shift both movable jaws relative to a stationary jaw of the vise.

A still further object of this invention is to provide an improved, rather simplified mechanism for releasably securing the two movable jaws of a vise on their associated operating slides.

Other objects of the invention will be apparent hereinafter from the specification and from the recital of the appended claims, particularly when read in conjunction with the accompanying drawings.

SUMMARY OF THE INVENTION

The vise includes a housing having in its upper surface an elongate recess with a cover plate secured thereover. Secured on the cover plate medially of its ends is a stationary jaw, and mounted for limited sliding movement on the cover plate adjacent opposite ends thereof are two movable jaws.

Mounted for limited sliding movement in the recess beneath the cover plate are front and rear slides, respectively, and each of which has thereon an integral knuckle which extends through a registering opening in the cover plate and is releasably secured to one of said movable jaws. Each knuckle has on one side thereof a pin having a flat surface engageable with a registering cam surface on the associated movable jaw, and has at its opposite side a spring-loaded, pivotal detent which is releasably engageable with another section of the associated movable jaw, thereby releasably to connect each such jaw to the associated slide.

To effect movement of the movable jaws toward and away from the fixed jaw, an elongate piston is mounted in the housing recess with one end of its rod or shank section secured to the rear slide, and projecting adjacent its opposite ends slidably in an axial bore in the front slide, and with the end of the piston remote from the rear slide having formed thereon an enlarged-diameter piston head which is mounted for limited axial movement in a counterbore formed in the end of the front slide remote from the rear slide. A hydraulic fluid supply duct is connected at one end to a blind bore formed coaxially through the piston head and part way into the piston rod, which has a reduced-diameter end portion thereof integral with one side of the piston head. The opposite side of the piston head is engaged by a compression spring which normally urges the piston head into ajaw opening position in which it is seated against the bottom of the counterbore in the front slide. To actuate the movable jaws, hydraulic fluid under pressure is fed through the supply duct and the bore in the piston head to the blind bore which extends into the piston rod. The reduced diameter portion of the piston shank, which is integral with the head of the piston, has therethrough a pair of diametrally opposed radial openings which enable fluid under pressure to enter the annular space surrounding the reduced-diameter piston rod so that the fluid under pressure engages the side of the piston head opposite to the side thereof engaged by the compression spring. This fluid under pressure moves the piston head in the front slide and against the resistance of the compression spring, at the same time shifting the attached rear slide, and hence the attached rear jaw, toward the stationaryjaw. When the compression spring prevents farther shifting of the piston head in the counterbore in the front slide, the fluid under pressure now in the space between the piston head and the bottom of the counterbore causes the front slide and its associated movable jaw to shift longitudinally relative to the piston head toward the stationary jaw and against the resistance of another set of compression springs.

When it is desired to permit the movable jaws to return to their open positions, the hydraulic fluid is permitted to return to the fluid supply thereby permitting the associated compression springs to return the front slide to its original position, after which the other compression spring engaged with the piston head forces the piston head back to its original position, thus opening both movable jaws.

THE DRAWINGS

DETAILED DESCRIPTION OF THE PREFERRED EMBODIMENTS

Figure 1:
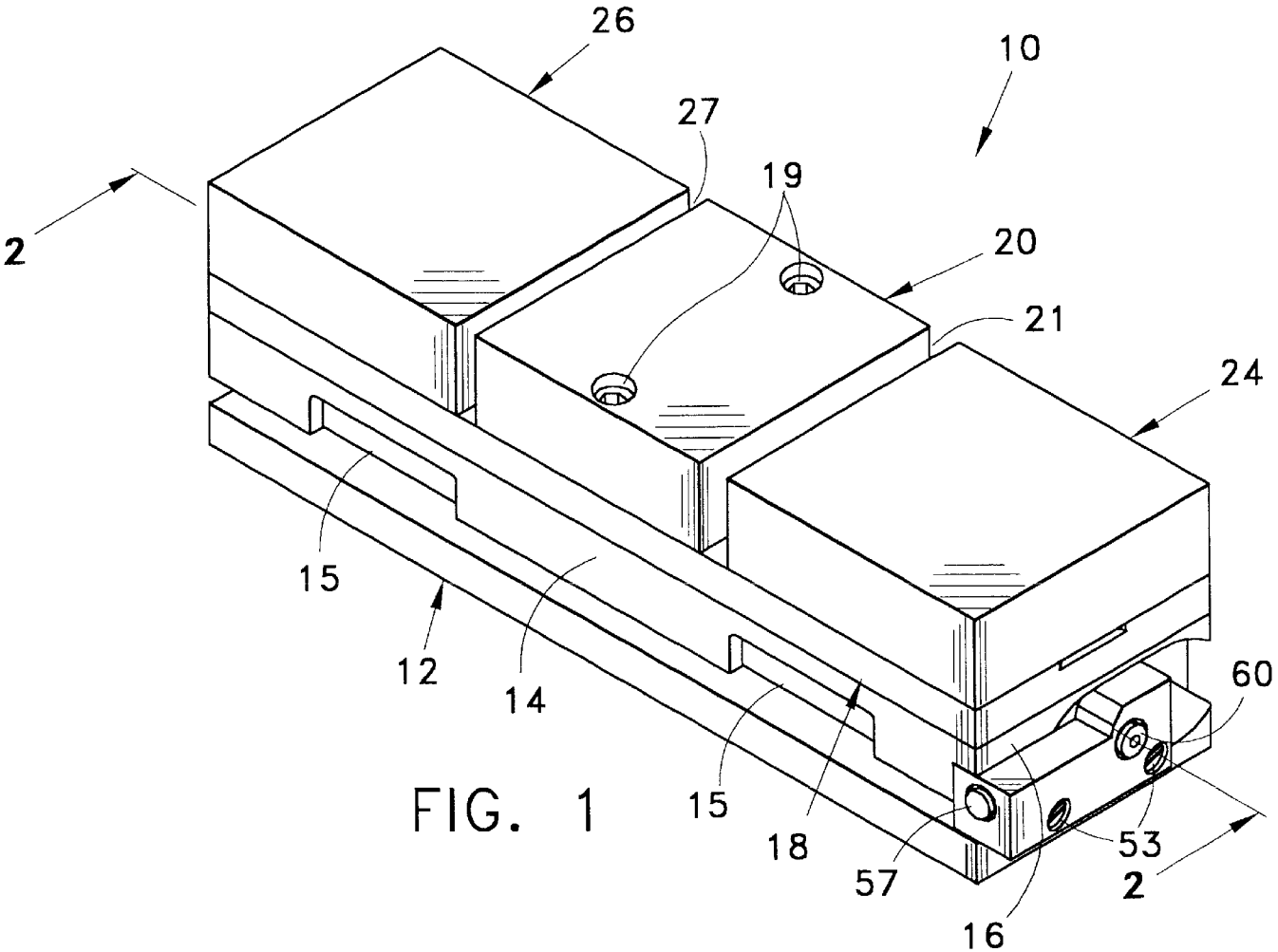
FIG. 1 is a perspective view of a double station hydraulically operated machining vise made according to one embodiment of this invention.

Referring now to the drawings by numerals of reference, and first to the embodiment shown in FIGS. 1 to 3, 10 denotes generally a double station hydraulically operated machining vise having an elongate, rigid base or housing 12, which in plan is generally rectangular in configuration. Base 12 has positioned centrally in its plane, upper surface an elongate recess 13, which likewise is generally rectangular in configuration, and which forms on base 12 a pair of spaced, parallel side walls 14 having in their outer surfaces spaced recesses 15, and forming also on support 12 a pair of spaced, parallel end walls 16.

Figure 2:
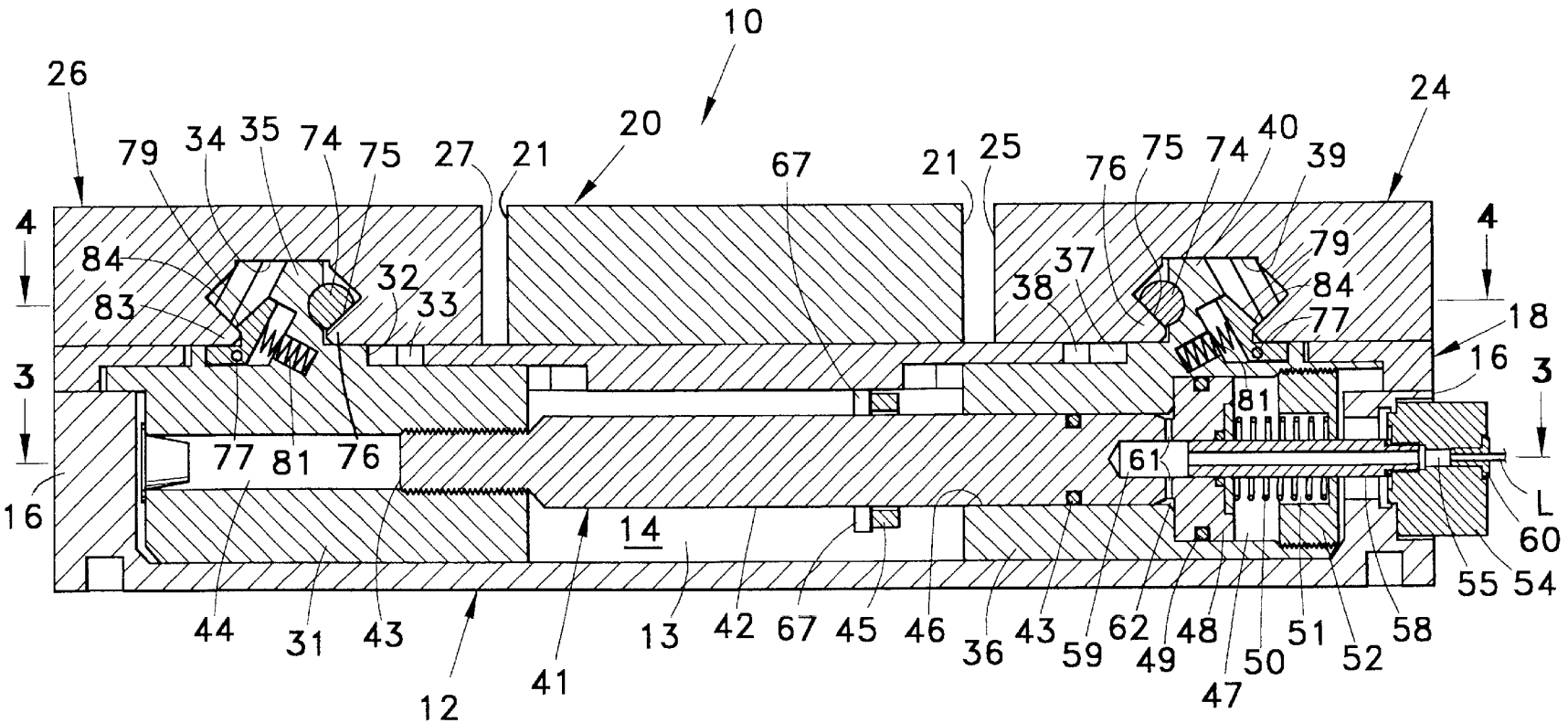
FIG. 2 is a slightly enlarged sectional view taken along the line 2—2 in FIG. 1 looking in the direction of the arrows.
Figure 3:
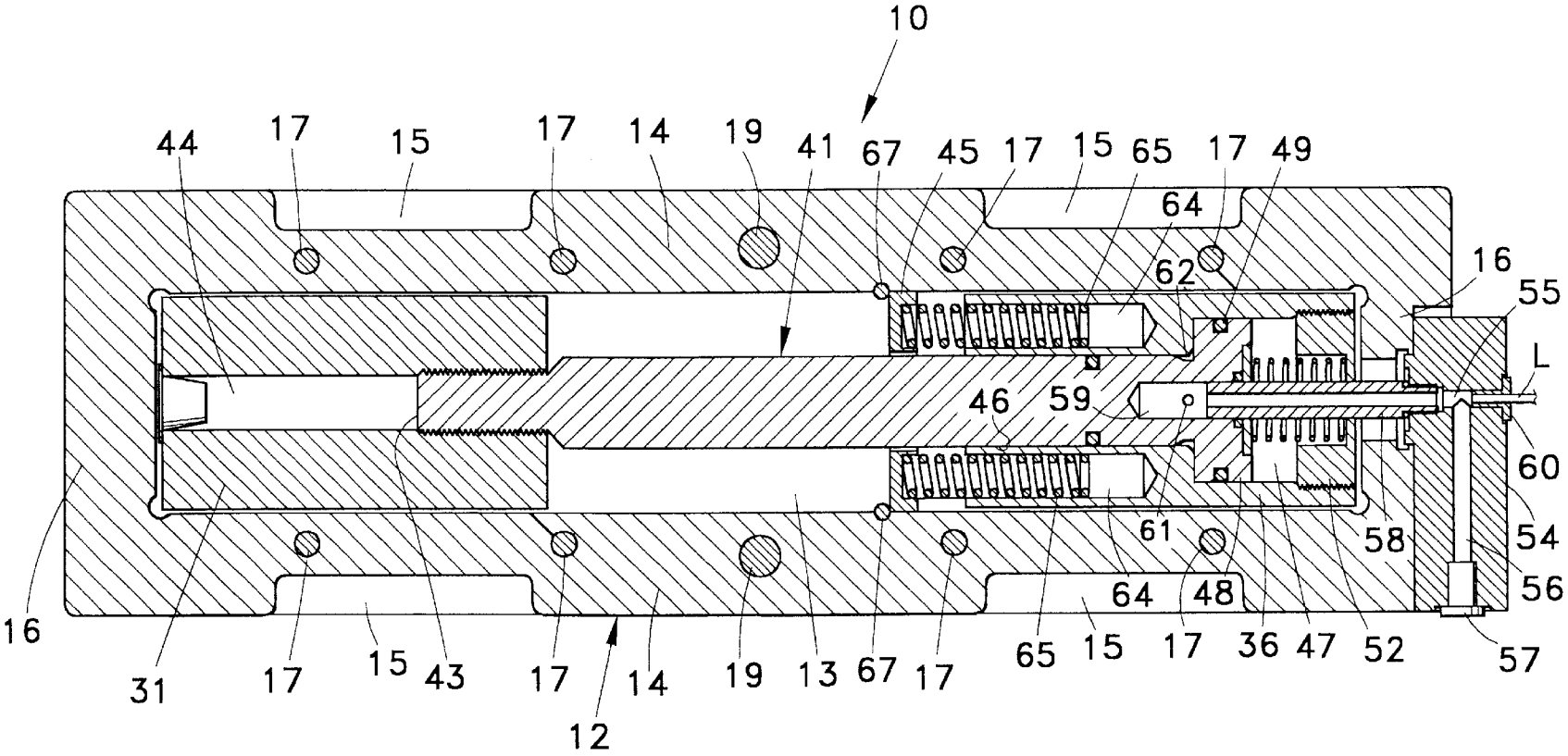
FIG. 3 is a sectional view on the same scale as FIG. 2 taken along the line 3—3 in FIG. 2 looking in the direction of the arrows.

Secured by a plurality of bolts 17 (FIG. 3) to the upper surface of base 12 over its recess 13 is a rectangularly shaped cover plate denoted generally by the numeral 18 in FIGS. 1 and 2. Secured on plate 18 medially of its ends by a pair of bolts 19, which extend through cover plate 18 into registering openings in the sidewalls 14 of base 12 as shown in FIG. 3, is a fixed center jaw denoted generally by the numeral 20. Jaw 20 is generally cubical in configuration and has a pair of spaced, parallel, plane end surfaces 21 (FIG. 2) disposed to be engaged by a workpiece as noted hereinafter. Mounted for limited sliding movement on the upper surface of cover plate 18 adjacent opposite ends thereof are two movable jaws, which are similar in configuration to the fixed jaw 20, and which i0 are denoted as the front jaw 24, and the rear jaw 26. At one end thereof (the left end in FIG. 2) jaw 24 has a plane, work engaging surface 25 which normally is disposed in spaced, confronting relation to one end wall 21 of the fixed jaw 20, and rearjaw 26 has on one end thereof a plane, work-engaging surface 27 which normally is disposed in spaced, confronting relation to the other end wall 21 of jaw 20.

Positioned between the rear jaw 26 and the cover 18 for limited sliding movement in the recess 13 of base 12 adjacent one end thereof is a rear slide 31, which like recess 13 is generally rectangular in configuration. Intermediate its ends slide 31 has formed on its upper surface a rectangularly shaped shoulder 32 which projects through a slightly longer rectangular opening 33 in cover plate 18 with portions of the shoulder 32 adjacent opposite ends thereof engaging the underside of rear jaw 26. Intermediate its ends the shoulder 32 has projecting upwardly therefrom, and into a registering opening 34 in the bottom of jaw 26 a rigid knuckle 35, which is employed for releasably securing the jaw 26 to slide 31 in a manner which will be described in greater detail hereinafter. Mounted for limited sliding movement in the recess 13 adjacent the opposite end thereof, and beneath cover plate 18 and the front jaw 24, is a front slide 36, which has in cross section a rectangular configuration similar to that of recess 13. On its upper surface slide 36 also has thereon a rectangularly shaped shoulder 37 which extends through a registering but longer opening 38 in a cover plate 18 to engage portions of the underside of the front jaw 24 intermediate its ends. Also as in the case of slide 31, the slide 36 has integral with and projecting upwardly from shoulder 37, and into a registering opening 39 in the underside of the front jaw 24 an integral knuckle 40, which is employed for releasably securing jaw 24 on the front slide 36 in a manner which will be described in greater detail hereinafter.

For operating the slides 31 and 36, a piston 41 is mounted for limited reciprocation in the recess 13 in base 12 longitudinally of the recess. The rod or shank section 42 of the piston 41 has on one end thereof (the left end as shown in FIGS. 2 and 3) an externally threaded, reduced-diameter section which is threaded into an internally threaded end of an axial bore 44 that extends through the rear slide 31, thereby securing slide 31 to the piston 41. Adjacent the opposite end thereof the cylindrical piston shank 42 extends slidably through an axial bore formed in the center of a rectangular spring retainer plate 45, and has a portion thereof surrounded by an annular piston seal 43 that extends slidably into an axial bore 46 formed in one end of the front slide 36. Bore 46 communicates coaxially with one end of an enlarged-diameter counterbore 47 which is formed in the opposite end of the slide 36, and which counterbore has slidably mounted therein the enlarged-diameter piston head 48 which at one side thereof (the left side as shown in FIGS. 2 and 3) is integral with a slightly reduced-diameter portion of the shank section 42 of the piston 41. Intermediate its ends head 48 has an annular piston seal 49 secured in a recess in its outer surface.

Piston 41 is normally held in a jaw opening position, as shown in the drawings, by a coiled compression spring 50, one end of which is seated against the side of the piston head 48 remote from the shank section thereof, and the opposite end of which is seated in a counterbore 51 formed in one end of a hydraulic cylinder cap 52 which is threaded into the outer end of the counterbore 47 in slide 36. Spring 50 thus normally maintains the piston head 48 seated against the bottom of the counterbore 47 in slide 36, in which position the front and rear jaws 24 and 26 are disposed in open positions relative to the fixed, centerjaw 20.

Secured by a pair of screws or bolts 53 (FIG. 1) to the end wall 16 of base 12 that confronts upon the front slide 36, is a hydraulic manifold 54 having therein coaxially of the piston 41 a hydraulic fluid supply bore 55 and a supplemental supply bore 56 opening at its inner end on bore 55 and closed at its outer end by a plug 57. The supply bore 55 has secured in its inner end one end of an axially bored hydraulic supply line or duct 58 which extends through a central opening in the closed end of the cylinder cap 52, and sealingly and coaxially into an axial bore 59 formed through the center of the piston head 48, and which extends partway into the adjacent end of the piston shank 42 which is integral with the piston head 48. In its outer end, the end remote from the supply line 58, the bore 55 in the manifold 54 has secured therein a tubular cap element 60 which is employed for connecting the bore 55 to one end of a tubular supply line L (FIGS. 2 and 3) which is employed for supplying hydraulic fluid under pressure to the supply line 58. As shown in FIGS. 2 and 3, the reduced-diameter portion of the piston rod, which is integral with the piston head 48, has therethrough a pair of registering, radial openings 61, which place the bore 59 in the piston 41 in communication with an annular recess 62, which is formed in the axial bore 46 of the front slide 36 around the outside of the reduced-diameter section of the piston rod 42. Consequently, when hydraulic fluid under pressure is introduced by line L through the bore 55 and supply line 58 to the bore 59 in the piston 41, the pressurized fluid is free to exit through openings 61 to the axial bore in the slide 36 and against the side of the piston head 48 remote from spring 50.

Referring again to FIG. 3, it will be noted that adjacent diametrally opposite sides thereof, slide 36 has therein a pair of spaced, parallel, axially extending blind bores 64 which extend partway into the slide 36 from the end thereof which confronts upon the spring retainer 45. Intermediate its ends, each of the bores 64 has secured therein one end of one of two coiled compression springs 65, the opposite ends of which springs are secured in registering recesses formed on the side of the spring retainer 45 which faces the slide 36. The side of the spring retainer remote from the slide 36 is engaged with a pair of dowel pins 67, which are secured in registering recesses formed in the confronting, inside surfaces of the sidewalls 14 of the base 12, and which dowel pins project slightly into the recess 13 and into the path of the retainer 45 to prevent any longitudinal movement of the retainer in recess 13 beyond the pins 67.

In use, when an operator wishes to secure a workpiece between the fixed jaw 20 and either the rearjaw 26 or front jaw 24, or alternatively, two workpieces betweenjaw 20 and the two movable jaws 24 and 26, the operator supplies fluid under pressure to line L, and hence to the blind bore 59 in the piston 41. As this pressure builds up and the fluid is transmitted through the openings 61 to the annular recess 62, the piston head 48 hence the piston 41 are urged axially toward the right in FIGS. 2 and 3 and against the resistance of the spring 50. During this initial movement the piston is moving relative to the front slide 36, but because the piston 41 is secured to the rear slide 31, the rear jaw 26 is shifted by slide 31 toward the right in FIGS. 2 and 3 either to engage the fixed jaw 20, or to clamp a workpiece between its surface 27 and the confronting end surface 21 on the fixed jaw 20. The rearjaw 26 and rear slide 31 are thus prevented from moving any further toward the right in FIGS. 2 and 3 relative to jaw 20.

At this time the piston head 48 will have shifted axially in the counterbore 47 of the front slide 36 toward the cylinder cap 52, thereby compressing spring 50, and at the same time allowing the incoming hydraulic fluid to accumulate in the counterbore 47 at the side of the piston head 48 confronting the bottom of counterbore 47. When piston 41 can no longer shift axially toward the right in base 12, the increasing pressure in the counterbore 47 exerts pressure on the bottom of the counterbore, thereby causing the front slide 36 to be shifted axially toward the left in FIGS. 2 and 3 relative to the piston head 48, thereby shifting the frontjaw 24 toward the fixed jaw 20 to secure a workpiece between the confronting surfaces of the jaws 20 and 24. During this movement of the front slide 36 the coiled compression springs 65 are compressed because the spring retainer 45 cannot move toward the left in FIGS. 2 and 3 beyond the dowel pins 67. At this stage, therefore, both the front jaw 24 and rear jaw 26 will be in operative positions in which they secure workpieces against opposite ends of the fixed jaw 20.

From the foregoing it will be apparent that if a workpiece is to be secured solely between the rear jaw 26 and the fixed jaw 20, the hydraulic fluid under pressure would be controlled so that once the workpiece has been secured between jaws 20 and 26, the incoming fluid under pressure would not be increased to the extent that it would cause simultaneous movement of the front slide 36 and its jaw 24 toward the left in FIGS. 2 and 3 against the resistance of the spring 65. However, assuming that both jaws 24 and 26 have been advanced to their clamping positions, in order to release the jaws, the hydraulic fluid is permitted to return from the counterbore 47 and through the ports or openings 61 and the supply duct 58 to the line L for delivery back to the hydraulic supply source. As the pressure of the fluid in the counterbore 47 diminishes, the springs 65 urge the front slide 36 toward the right relative to the piston head in housing 12, thereby returning the front jaw 24 to its open position, and the spring 50 urges the piston head 48, hence the piston 41 toward the left relative to housing 12 thereby returning the rear jaw to its open position, at which time the piston head 48 once again becomes seated against the bottom of the counterbore 47 as shown in the drawings.

Figure 4:
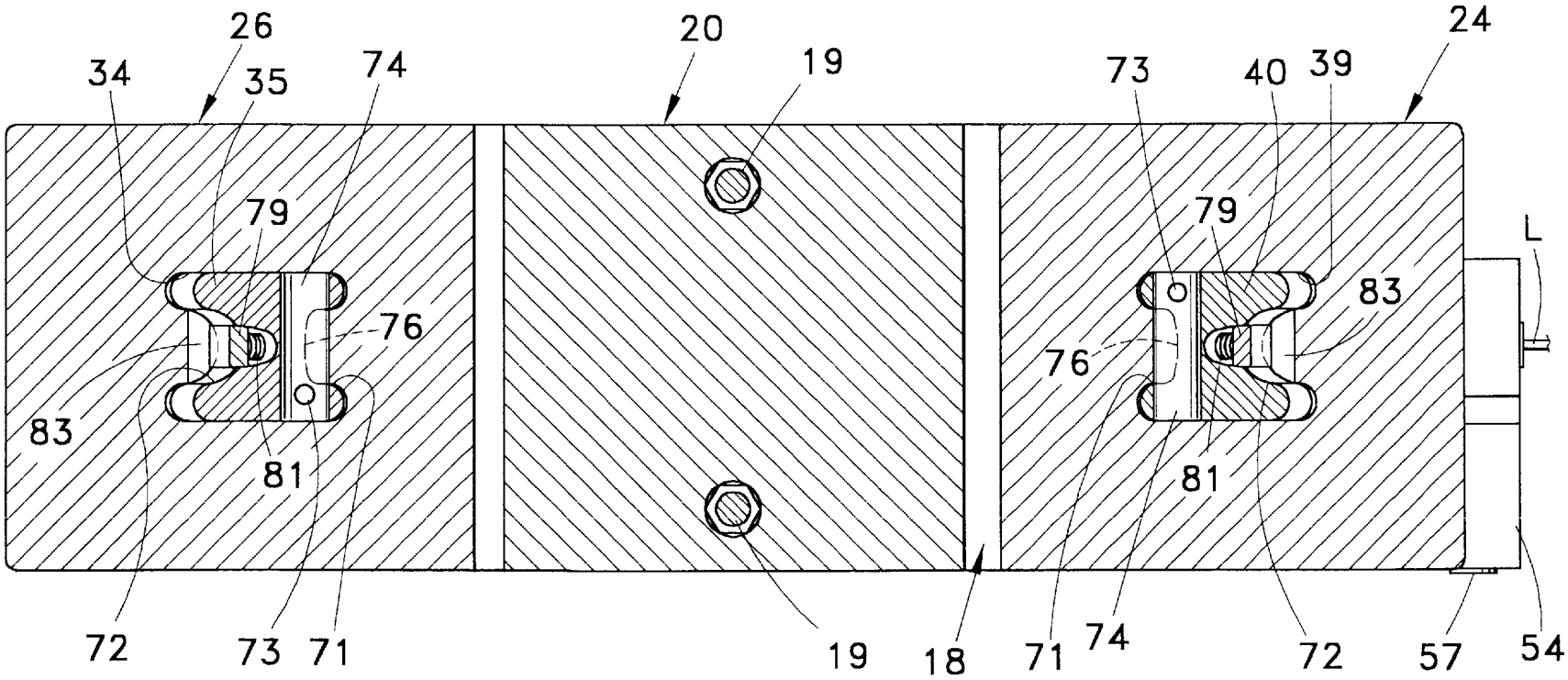
FIG. 4 is a sectional view taken along the line 4—4 in FIG. 2 looking in the direction of the arrows.

Referring now to the means for removably securing the jaws 24 and 26 on the slides 36 and 31, respectively, the means for removably attaching the jaws to the slides is essentially the same for each jaw, so that the same numerals will be employed to denote similar parts. In any event, referring now to FIGS. 2 and 4, it is to be noted at the outset that the knuckles 35 and 40 on the slides 31 and 36, respectively, are generally similar in configuration, at least in plan, to the knuckles 104 and 102 disclosed in the above-noted U.S. Pat. No. 6,017,026. In this connection each knuckle 35 and 40 has in opposite sides thereof generally U-shaped recesses 71 and 72, respectively. As shown in FIG. 4, the recesses 71 face in the direction of the stationary jaw 20, while the recesses 72 face in the opposite directions. Also as disclosed in U.S. Pat. No. 6,017,026, mounted by a retainer pin 73 in each knuckle 35 and 40 for limited rotation in the side thereof facing the fixed jaw 20 is a cylindrically shaped pin 74. Each of the pins 74 has formed on its outer peripheral surface an axially extending flat surface 75, which engages a correspondingly flat camming surface formed on a generally tongue shaped projection 76 that extends from one side of each of the recesses 34 and 39 in the jaws 26 and 24, respectively, for removable engagement beneath the associated pins 74.

Pivotally mounted adjacent their lower ends by pins 77 for limited pivotal movement in the bottoms of the recesses 72 in the knuckles 35 and 40 are pivotal detents 79. With the jaws 24 and 26 mounted respectively on the slides 31 and 36 as shown in FIG. 2, compression springs 81 retain the detents 79 resiliently in jaw locking positions in which generally tongue-shaped projections 83 formed on jaws 24 and 26 adjacent the lower ends of their recesses 34 are releasably secured beneath projections 84 formed on the sides of the detents 79 remote from their associated springs 81. For eachjaw 24 and 26, therefore, the pins 74 and detents 79 function releasably to secure those jaws on their respective slides 36 and 31.

From the foregoing it will be apparent that the present invention provides relatively simple and inexpensive means for hydraulically operating the two jaws of a double station machining device. The hydraulically operated mechanism disclosed herein results in a very efficient and inexpensive alternative to prior such mechanisms which utilized separate hydraulic systems for each of the two different movable jaws. With the mechanism herein, a single, hydraulic supply is utilized for operating both movable jaws of a double station machining vise considerably reducing the number of parts necessary for operating the vise. Despite its proximity to the ports or openings 61, the line 58 does not at any time prevent the flow of fluid through ports 61 to recess 62. Also, the means for releasably securing the movable jaws to their respective operating slides is simplified by utilizing the single spring-loaded detent, and cooperating the pin with the flat surface thereon for retaining a jaw on its associated slide.

While this invention has been illustrated and described in detail in connection with only certain embodiments thereof, it will be apparent that this application is intended to cover any such modifications as may fall within the scope of one skilled in the art or the appended claims.

What is claimed is:

1. In a two station machining device having a stationary jaw secured on the work surface of a housing between two movable jaws, and having a pair of spaced slides connected to said movable jaws and reciprocable in a recess in said housing beneath said work surface for moving the movable jaws between open and closed positions with respect to said stationary jaw, the improvement comprising a piston in said recess extending between said slides with one end thereof secured to one of said slides, and with the other end thereof sealingly slidable in an axial bore in the other of said slides, resilient means normally retaining said slides and said piston in first limit positions in which said movable jaws are in said open positions, and operating means for supplying hydraulic fluid under pressure to said bore in said other slide and operative initially to move said piston and said one slide relative to said other slide, and into second limit positions in which the jaw connected to said one slide is moved to its closed position, said operating means being operative after said piston and said one slide have reached their second limit positions, to cause said other slide to be moved relative to said piston to a second position in which the jaw connected thereto is moved to its closed position relative to said stationary jaw.

2. A two station machining device as defined in claim 1, wherein said operating means is operable to release said hydraulic fluid from said bore in said other slide thereby to permit said resilient means to return said slides and said piston to their respective first limit positions.

3. A two station machining device as defined in claim 1, wherein said piston has on said one end thereof an enlarged diameter piston head slidable coaxially in a counterbore formed in the end of said other slide remote from said one slide, said resilient means includes a spring mounted in said counterbore and normally urging one side of said piston head into a position of rest against the bottom of said counterbore when said slides are in said first limit positions, said axial bore in said other slide has formed therein an annular recess surrounding said piston and opening at one side thereof on said one side of said piston head, and said operating means supplies said fluid under pressure to said annular recess to initiate said movements of said piston and said one slide to said second limit positions.

4. A two station machining device as defined in claim 3, wherein said one end of said piston has therein an axial blind bore extending coaxially through said piston head, and has therein at least one opening connecting said blind bore to said annular recess, and said operating means includes a tubular supply duct secured intermediate its ends in said end of said other slide remote from said one slide, said supply duct having one end thereof disposed to be connected to a supply of hydraulic fluid under pressure, and having the opposite end thereof extending slidably and sealingly into said blind bore to deliver fluid under pressure through said opening to said annular recess.

5. A two station machining device as defined in claim 4, wherein said operating means further includes, a hydraulic fluid manifold secured to said end of said other slide remote from said one slide and having therethrough a primary fluid supply bore secured coaxially at one end thereof to said one end of said supply duct and disposed to be connected at its opposite end to said supply of hydraulic fluid under pressure, said manifold having therein an alternative fluid supply bore communicating at one end with said primary supply bore intermediate the ends thereof, and having its opposite end opening on the exterior of said manifold and normally being closed by a removable plug.

6. A two station machining device as defined in claim 1, wherein each of said slides has an integral knuckle projecting from an upper surface thereof through a registering opening in said work surface of said housing, and into a recess in the bottom of the associated movable jaw to which the slide is releasably connected, each of said knuckles has mounted on one side thereof a pin retainer extending transversely of the direction of movement of said movable jaws and having thereon a flat surface releasably engaged with a registering surface formed at one side of the recess in the associated movable jaw, and each of said knuckles has a spring-loaded detent pivotally mounted adjacent one end thereof to the associated knuckle at the side thereof opposite the associated pin retainer, and having thereon adjacent its opposite end a generally tongue-shaped projection releasably and resiliently engaged with a registering projection formed in the opposite side of the recess in the associated movable jaw.

7. A two-station machining device as defined in claim 1, wherein said piston includes a cylindrical piston rod secured at one end to said one slide, and having at its opposite end a reduced diameter portion thereof integral with one end of an enlarged diameter head of said piston, said piston head is mounted for limited reciprocation in a counterbore formed in the end of said other slide remote from said one slide and normally has said one end thereof seated resiliently against the bottom of said counterbore when said piston is in said first limit position thereof, said reduced diameter portion of said piston rod is surrounded by an annular recess in the axial bore of said other slide when said piston head is seated against the bottom of said counterbore, and said operating means includes means for supplying said hydraulic fluid to said annular recess in said bore to initiate movement of said piston and said one slide to said second limit positions thereof.

8. A two-station machining device as defined in claim 7, wherein said other end of said piston has therein a blind bore extending coaxially through said piston head and part way into said piston rod, the portion of said piston rod containing said blind bore having therein at least one opening connecting said blind bore to said annular recess in said bore, and said means for supplying hydraulic fluid to said bore includes a tubular duct secured intermediate its ends in the end of said other slide remote from said one slide, and with one end of said duct disposed to be connected to a supply of hydraulic fluid under pressure, and with the opposite end thereof extending slidably and sealingly into said blind bore in said piston.

9. A two station machining device, comprising a housing having thereon an elongate working surface with a stationary jaw secured on said surface medially thereof and between a pair of movable jaws reciprocable on said surface between open and closed positions with respect to said stationary jaw, a pair of slides reciprocable in an elongate recess in said housing beneath said surface and releasably connected to said movable jaws to effect movement thereof between said open and closed positions, a piston in said recess in said housing having a cylindrical rod section secured at one end thereof to one of said slides and extending sealingly and slidably adjacent its opposite end into an axial bore in the other of said slides, said rod section having on said opposite end thereof a reduced diameter section thereof integral with one end of an enlarged diameter piston head section reciprocable in a counterbore formed in the end of said other slide remote from said one slide, resilient means normally urging said slides and piston into first limit positions in which said movable jaws are in said open positions and said head section of the piston is seated against the bottom of said counterbore, and means for supplying hydraulic fluid under pressure to said axial bore in said other slide in the area surrounding said reduced diameter section of said rod and operative successively to move said other slide and then said one slide to second limit positions and their associated movable jaws successively to their closed positions with respect to said stationary jaw.

10. A two station machining device as defined in claim 9, wherein each of said slides has thereon an integral knuckle projecting through a registering opening in the work surface of said housing, and into a recess in the bottom of the associated movable jaw to which the slide is releasably connected, each of said knuckles has mounted on one side thereof a pin retainer having thereon a flat surface releasably engaged with a registering surface formed on one side of the recess in the associated movable jaw, and each of said knuckles has a spring-loaded detent pivotally mounted adjacent one end thereof on the associated knuckle at the side thereof opposite the associated pin retainer, and having thereon adjacent its opposite end a generally tongue-shaped projection releasably and resiliently engaged with a registering projection formed in the opposite side of the recess in the associated movable jaw.

11. A two station machining device as defined in claim 9, wherein said resilient means comprises, first spring means normally retaining said piston head against the bottom of said counterbore and said one slide and said piston into said first limit positions thereof, and second spring means normally urging said other slide into said first limit position thereof, said second spring means being operative to prevent movement of said other slide relative to said piston until said one slide has reached said second limit position thereof.

* * * * *